US010370069B2

(12) United States Patent
Koop et al.

(10) Patent No.: US 10,370,069 B2
(45) Date of Patent: Aug. 6, 2019

(54) MULTIFUNCTIONAL SYSTEM FOR DAMPING A SHIP'S MOTION

(71) Applicant: Quantum Controls B.V., Nuth (NL)

(72) Inventors: Theo Koop, Tilburg (NL); Lambertus Johannes Maria Dinnissen, Nuth (NL)

(73) Assignee: Quantum Controls B.V. (NL)

( * ) Notice: Subject to any disclaimer, the term of this patent is extended or adjusted under 35 U.S.C. 154(b) by 0 days.

(21) Appl. No.: 15/772,307

(22) PCT Filed: Oct. 26, 2016

(86) PCT No.: PCT/NL2016/050740
§ 371 (c)(1),
(2) Date: Apr. 30, 2018

(87) PCT Pub. No.: WO2017/074181
PCT Pub. Date: May 4, 2017

(65) Prior Publication Data

US 2018/0319466 A1 Nov. 8, 2018

(30) Foreign Application Priority Data

Oct. 28, 2015 (NL) ..... 2015674

(51) Int. Cl.
*B63B 39/06* (2006.01)

(52) U.S. Cl.
CPC ..... *B63B 39/06* (2013.01); *B63B 2039/065* (2013.01)

(58) Field of Classification Search
CPC ..... B63B 39/06
(Continued)

(56) References Cited

U.S. PATENT DOCUMENTS 3,757,723 A 9/1973 Pangalila
2005/0145151 A1* 7/2005 Koop ..... B63B 39/06 114/126
2015/0259052 A1* 9/2015 Skauen ..... B63B 39/06 114/126

FOREIGN PATENT DOCUMENTS

CN 203832725 U 9/2014
EP 1498348 A1 1/2005
(Continued)

OTHER PUBLICATIONS

PCT International Search Report and Written Opinion of the International Searching Authority (PCT/ISA/210 and PCT/ISA/237) by the ISA European Patent Office dated Feb. 9, 2017 for PCT application No. PCT/NL16/50740 filed Oct. 26, 2016 and published as WO 2017/074181 dated May 4, 2017.

*Primary Examiner* — Stephen P Avila
(74) *Attorney, Agent, or Firm* — Suiter Swantz pc llo

(57) ABSTRACT

The invention relates to a device for damping a vessel's motion using a lifting effect, comprising at least one first stabilisation element that extends from the vessel's hull, below the water line, on a side of the vessel, which at least one stabilisation element is configured as a wing, sensor means for sensing the vessel's motion and delivering control signals on the basis thereof, as well as moving means for moving the at least one wing-shaped stabilisation element relative to the hull. According to the invention, the system is to that end characterised in that the moving means are configured for imparting a pivoting movement in the direction of the stem or the stern of the vessel to the at least one wing-shaped stabilisation element and setting a tilt angle of the at least one wing-shaped stabilisation element relative to the ship's hull in dependence on the speed of the vessel and the control signals delivered by the sensor means, such that the lifting effect generated by the at least one wing-shaped
(Continued)

stabilisation element will have a damping effect on the ship's motion being sensed.

12 Claims, 14 Drawing Sheets

(58) Field of Classification Search
USPC ..... 114/126
See application file for complete search history.

(56) References Cited

FOREIGN PATENT DOCUMENTS

| | | | |
|---|---|---|---|
| EP | 2277771 | A1 | 1/2011 |
| EP | 2910463 | A1 | 8/2015 |
| WO | 2013095097 | A1 | 6/2013 |

* cited by examiner

MULTIFUNCTIONAL SYSTEM FOR DAMPING A SHIP'S MOTION

The invention relates to a device for damping a vessel's motion using a lifting effect, comprising at least one first stabilisation element that extends from the vessel's hull, below the water line, on a side of the vessel, which at least one stabilisation element is configured as a wing, sensor means for sensing the vessel's motion and delivering control signals on the basis thereof, as well as moving means for moving the at least one wing-shaped stabilisation element relative to the hull.

Such an active system for damping a ship's motion is known, for example from NL patent No. 1027525. In said patent it is proposed to configure a stabilisation element that extends from the ship's hull below the waterline as a wing-shaped stabilisation element. This wing-shaped stabilisation element is rotated about its longitudinal axis so as to compensate for the vessel's roll. The vessel is for that purpose fitted with sensor means, for example angle sensors, speed sensors and acceleration sensors, by means of which the angle, the speed or the acceleration of the roll are sensed. Control signals are generated on the basis of the data being obtained, which signals control the rotation of the rotatable stabilisation element as regards the direction of rotation and the speed of rotation of the stabilisation element as well as the movement of the stabilisation element relative to the vessel.

Under the influence of the rotational movement of the wing-shaped stabilisation element and the water flowing past as a result of the stabilisation element moving relative to the stationary vessel, a correction force perpendicular to the direction of rotation and the direction of movement is generated. This physical phenomenon is also referred to as the Magnus effect, on the basis of which the correction force is used for opposing the vessel's roll. This stabilisation system based on the Magnus effect already provides a very large correction force at very slow sailing speeds through the water, which force is used as a lifting force for opposing the ship's roll.

This is an ideal solution in the case of slow sailing ships. The stabilisation system is primarily used with stationary vessels, however, wherein the rotating wing-shaped stabilisation elements make a reciprocating, translational movement relative to the hull, and wherein the relative speed of the water flowing past the translating, rotating wing-shaped stabilisation element is utilised for realising the correctional Magnus effect.

A similar use of the Magnus effect is described in EP 2 910 463, in which a rotating stabilisation element is used for damping a ship's motion.

A drawback of the stabilisation systems described in NL 1027525 and EP 2 910 463 is that a reciprocating translational movement relative to the ship's hull is imparted to the rotating, wing-shaped stabilisation elements by the moving means. This means constant switching over of the moving means for accelerating and decelerating the mass of the rotating stabilisation element in one translation direction and accelerating and decelerating the mass of the rotating stabilisation element in the other, opposite translation direction. The mass inertia of the system further has an adverse effect on the smooth functioning of the system, because also the direction of rotation of the wing-shaped stabilisation elements must constantly be reversed by actuating the driving means.

This acceleration-deceleration and reacceleration of mass constitutes a severe demand on the energy supply on board the vessel in question. A heavy load is placed on the generators of the moving means or driving means, which load varies constantly on account of the switching over that is required. This variation is offset as much as possible by (in the case of hydraulic drive) the use of accumulators that level off the peak currents. In the case of direct electric drive this will be more difficult, and an even more complex and costly on-board installation will be required.

In another application, which is described in WO 2013/095097, a wing-shaped stabilisation element is moved away from and toward the water surface, each time displacing a substantial mass of water. The reaction force thus created is used to compensate for the ship's motion. Also in this application, however, a large mass or wing area is to be moved to and fro through the water.

The mass forces that occur therewith have an adverse effect on the functionality of this stabilisation system. They do not contribute to the stabilisation and consequently increase the force requirement and thus the power requirement. The resistance forces generated in this way place a heavy load on the generators of the moving means or the driving means in this case as well. As a consequence, an overdimensioned power train of the stabilisation element is required.

Accordingly it is an object of the invention to provide an active system for damping a ship's motion as described in the introduction. According to the invention, the moving means are configured for imparting a pivoting movement in the direction of the stem or the stern respectively of the vessel to the at least one wing-shaped stabilisation element and setting a tilt angle of the at least one wing-shaped stabilisation element relative to the ship's hull in dependence on the speed of the vessel and the control signals delivered by the sensor means, such that the lifting effect generated by the at least one wing-shaped stabilisation element will have a damping effect on the ship's motion being sensed.

The constructional drawbacks of the known rotating stabilisation systems are thus offset. By no longer imparting a rotational movement to the stabilisation elements but configuring them as wing-shaped stabilisation elements and imparting an angular or pivoting movement through the water thereto at a tilt angle that may or may not be fixed, it is no longer necessary to constantly change the direction of rotation of the rotating mass of the rotating stabilisation elements. Instead thereof, only the tilt angle of the wing-shaped stabilisation elements must constantly be adapted, as must the angular or pivoting movement relative to the vessel, in dependence on the ship's motion (the ship's roll) being sensed and the speed of the vessel.

This mass movement is significantly smaller, so that the entire drive system (driving means and moving means) can be of simpler construction. It is therefore noted that in this invention the stabilisation elements are not rotatably driven, whilst in addition they have a wing-shaped configuration. The driving means that impart a rotational movement to the stabilisation elements in the known roll stabilisation systems are thus not present in this invention, which, in addition to a saving in costs, also leads to a simpler overall construction.

In this invention, the compensation of the ship's motion (the ship's roll) being sensed does not take place on the basis of the above-described Magnus effect, therefore, but on the basis of the lifting effect created by the wing-shaped stabilisation elements.

In order to have the stabilisation system according to the invention function optimally, the moving means are configured for setting the at least one wing-shaped stabilisation element at a tilt angle at a sailing speed v=0 kn whilst at the same time imparting a pivoting movement relative to the ship's hull to the at least one wing-shaped stabilisation element. In this way the active roll stabilisation system is very effective with stationary ships (ships at anchor), for example in a harbour, wherein the wing-shaped stabilisation element is pivoted to and fro through the water and wherein, depending on the set tilt angle of the wing-shaped stabilisation element, a lifting effect is realised by the water flowing past as an effective compensation of the roll stabilisation.

In another functional embodiment of the stabilisation system according to the invention, the moving means are configured for imparting a variable tilt angle to the at least one wing-shaped stabilisation element at a speed v≠0 kn whilst at the same time setting a fixed pivot angle of the at least one wing-shaped stabilisation element relative to the hull. In this embodiment, the active roll stabilisation system is very suitable during sailing wherein the wing-shaped stabilisation element is set in a fixed position relative to the vessel, wherein a lifting effect is likewise realised by the water flowing past, as an effective compensation of the roll stabilisation, by varying the tilt angle of the wing-shaped stabilisation element.

It is noted, however, that the angular (read: pivoting) movement and direction as well as the tilt angle can be set independently by the moving means in dependence on a desired effective stabilisation of the vessel's roll.

According to another embodiment, the wing-shaped stabilisation element is according to the invention connected to the vessel by means of a universal joint, so that a pivoting movement through the water relative to the vessel can be imparted to the non-rotatable wing-shaped stabilisation element in an effective manner.

In a specific embodiment of the aspect of the invention, the wing-shaped stabilisation element can be accommodated in a recess provided in the ship's hull, so that the wing-shaped stabilisation can be placed back in the ship's hull while sailing, so that the friction between the vessel and the water while sailing will significantly decrease.

The wing-shaped stabilisation element may optionally be accommodated in a guide formed in or on the ship's hull, which guide preferably extends at last in part in the longitudinal direction of the vessel.

According to another functional embodiment, a wing-shaped stabilisation element may be provided on each longitudinal side of the vessel or only on one side, whilst in a preferred embodiment the set of wing-shaped stabilisation elements is provided near the rear of the vessel.

In a specific embodiment of the active roll stabilisation system according to the invention, the wing-shaped stabilisation element is provided with a winglet at its free end. This reduces any swirling in the water flowing past the wing-shaped stabilisation element (with stationary ships as well as with moving ships), as a result of which the wing-shaped stabilisation element can on the one hand be moved through the water in a simpler and more efficient manner, so that the drive system can be of less sturdy construction. The induced resistance experienced by the stabilisation element in the water will furthermore decrease.

In a preferred embodiment, the winglet is directed toward the water surface or away from the water surface.

In another functional embodiment according to the invention, the wing-shaped stabilisation element has an Aspect-Ratio ranging between 1 and 10. By using a wing-shaped stabilisation element having such a large Aspect-Ratio, an enhanced lifting effect for damping the ship's roll is realised, so that the active roll stabilisation system provided with such a wing-shaped stabilisation element (having a high AR) can also be used for applications other than roll stabilisation, for example for trimming the vessel, or for compensating for the vessel's pitch or even for repositioning or manoeuvring the vessel without making use of the usual main propulsion system of the vessel or of bow and stern thrusters.

In this latter embodiment, the active roll stabilisation system according to the invention further comprises location determination means, and the moving means impart the angular displacement to the at least one wing-shaped stabilisation element and set the tilt angle of the at least one wing-shaped stabilisation element in part on the basis of the determined position of the vessel.

This makes it possible, by imparting a "wagging" motion to the wing-shaped stabilisation element, to keep the vessel in its position in the harbour, or even move it over small distances, without making use of the vessel's main propulsion system, so that manoeuvres can be carried out in a controlled manner.

The invention will now be explained in more detail with reference to a drawing, in which:

FIGS. 1-4 are views of active stabilisation systems according to the prior art;

FIGS. 5A-B-C are views of a first embodiment of an active stabilisation system according to the invention;

Figure 1:
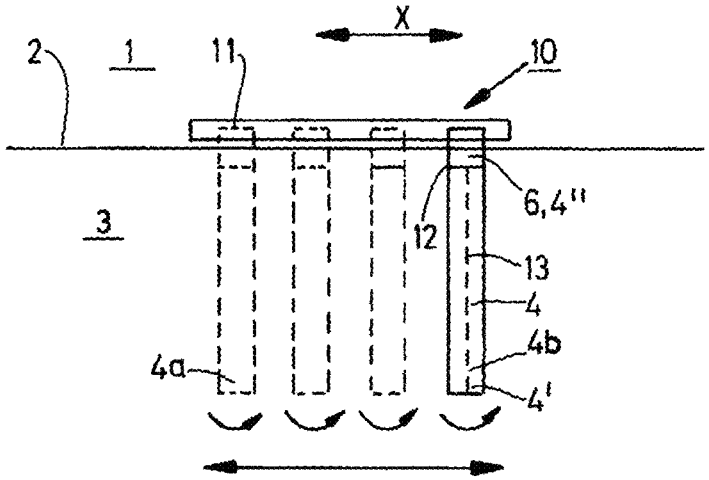

In FIGS. 1-4 embodiments of active stabilisation systems according to the prior art are shown. The stationary vessel 1 floating on a water surface 3 is provided with an active stabilisation system indicated by reference numerals 10-11-20-10'-20'. This known active system for damping a ship's motion as described in Dutch patent NL 1027525 is made up of rotatable stabilisation elements 4*a* and 4*b*, which each project from a respective longitudinal side of the hull 2 of the vessel below the waterline.

The active stabilisation system according to the prior art is also provided with sensor means (not shown, however) which sense the ship's motion and more in particular the ship's roll. On the basis of this, control signals are delivered to driving means (likewise not shown), which rotatably drive either one of the stabilisation elements 4*a* or 4*b* (depending on the correction to be carried out). Said sensor means may consist of angle sensors, speed sensors or acceleration sensors, which continuously sense the angle of the ship relative to the horizontal water surface 3 and the speed or the acceleration caused by the ship's roll.

FIG. 1 shows an embodiment of a known active stabilisation system provided with a set of rotatable stabilisation elements. The stabilisation elements may be configured as a cylinder or as a wing. The active stabilisation system comprises moving means which move the rotatable stabilisation element 4 with respect to the stationary vessel. More in particular, FIG. 1 shows an embodiment in which the moving means 10 impart a reciprocating translational movement between two extreme positions 4*a* and 4*b* to the rotatable stabilisation element, such that said movement comprises at least a component in the longitudinal direction of the vessel. The longitudinal direction of the vessel is indicated by the wide arrow X in FIG. 1.

In the case of the translating embodiment of the active stabilisation system shown in FIG. 1 (see also FIG. 2), the translational movement of the rotatable stabilisation element 4 is made possible in that a guide 11 is mounted in the hull 2 of the vessel 1, along which guide the stabilisation element 4 can be moved. The rotatable stabilisation element 4 is to that end accommodated in the guide 11 with one end 4' via a universal joint 12, so that translational movement in the guide 11 on the one hand and a rotational movement about the longitudinal axis 13 on the other hand are possible.

Although this is schematically shown, the rotatable stabilisation element 4 is connected to the driving means 6 by means of a universal joint 12, which driving means rotatably drive the stabilisation element 4 for the purpose of damping the ship's motion being sensed. In this embodiment, the assembly of the driving means 6 and the universal joint 12 (which enables the stabilisation element 4 to rotate with respect to the driving means 6 and the vessel 1) can translate along the guide 11, for example via a rack-and-pinion transmission mechanism (not shown).

Also other translational transmission mechanisms can be used for this purpose, however.

The reciprocating translational movement of the rotatable stabilisation element 4 in the guide 11, between the extreme positions 4*a* and 4*b*, in the longitudinal direction X of the stationary vessel 1 combined with the rotational movement of the stabilisation element 4 results in a reactive force, also referred to as the Magnus force. This force is perpendicular both to the direction of movement of the stabilisation element 4 in the X-direction and to the direction of rotation thereof.

Depending on the direction of the ship's motion (the ship's roll) to be damped, the direction of rotation of the stabilisation element 4 must be selected so that the resulting Magnus force $F_M$ will oppose the rolling force $F_R$ being exerted on the vessel as a result of the ship's roll.

Figure 2:
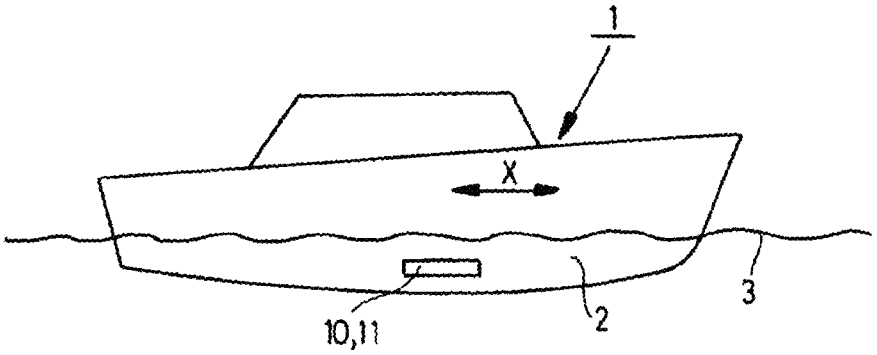
Figure 3:
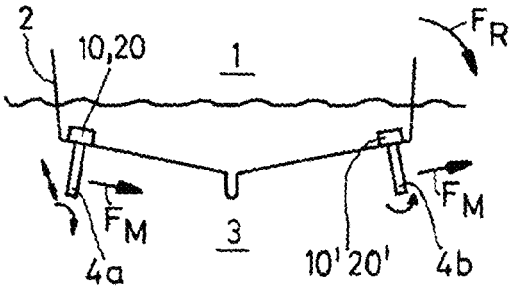

This is shown in FIG. 3, in which the translating rotatable stabilisation elements 4*a*-4*b* are disposed below the water line 3, near the centre of the vessel (see FIG. 2). The direction, the speed as well as the acceleration of the roll can be sensed in a manner which is known per se, using suitable sensor means (angle sensor, speed sensor and acceleration sensor). Control signals are delivered on the basis thereof to the respective driving means 6 and 10. On the basis of said signals, the driving means 6 will drive the stabilisation element 4 at a speed and in a direction which may or may not be varied, whilst the moving means 10 will also move the rotating stabilisation element 4 in the longitudinal direction X in the guide 10 at a certain speed.

Figure 4:
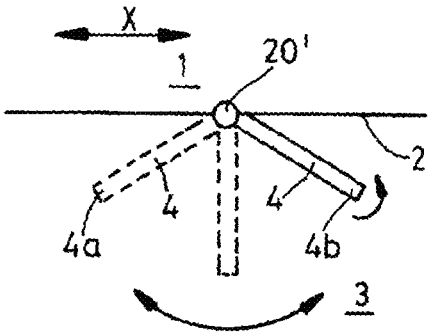

In FIG. 4 another embodiment of a known active stabilisation system is shown, in which the moving means (indicated at 20 here) impart a reciprocating pivoting movement between two extreme positions 4*a* and 4*b* with respect to the stationary vessel 1 to the stabilisation element 4. In order to ensure that the active stabilisation system will function adequately with stationary vessels, it is desirable, also in the embodiment shown in FIG. 4, that the pivoting movement imparted to the rotatable stabilisation element 4 by the moving means 20 should comprise at least a motion component in the longitudinal direction X of the vessel 1.

In the above setup, using a suitable control and drive of the stabilisation element 4 in terms of rotational speed, direction and pivoting speed and direction, the Magnus effect in the case of a stationary vessel being at anchor will for example result in a Magnus force $F_M$ comprising at least a force component in the direction of or away from the water surface 3. Said upward or downward, as the case may be, force component of the Magnus force $F_M$ can be utilised very effectively for compensating the roll of the stationary vessel about its longitudinal axis X.

A major drawback of the currently known active stabilisation systems that function on the basis of the Magnus effect is that at present they can only be used with stationary ships and ships sailing at a very slow speed. At present a stabilisation device based on the Magnus effect which can be used with ships that sail at a high speed is not available yet. In addition to that, a higher frictional resistance is experienced while sailing, which renders the known systems unsuitable.

Figure 5A:
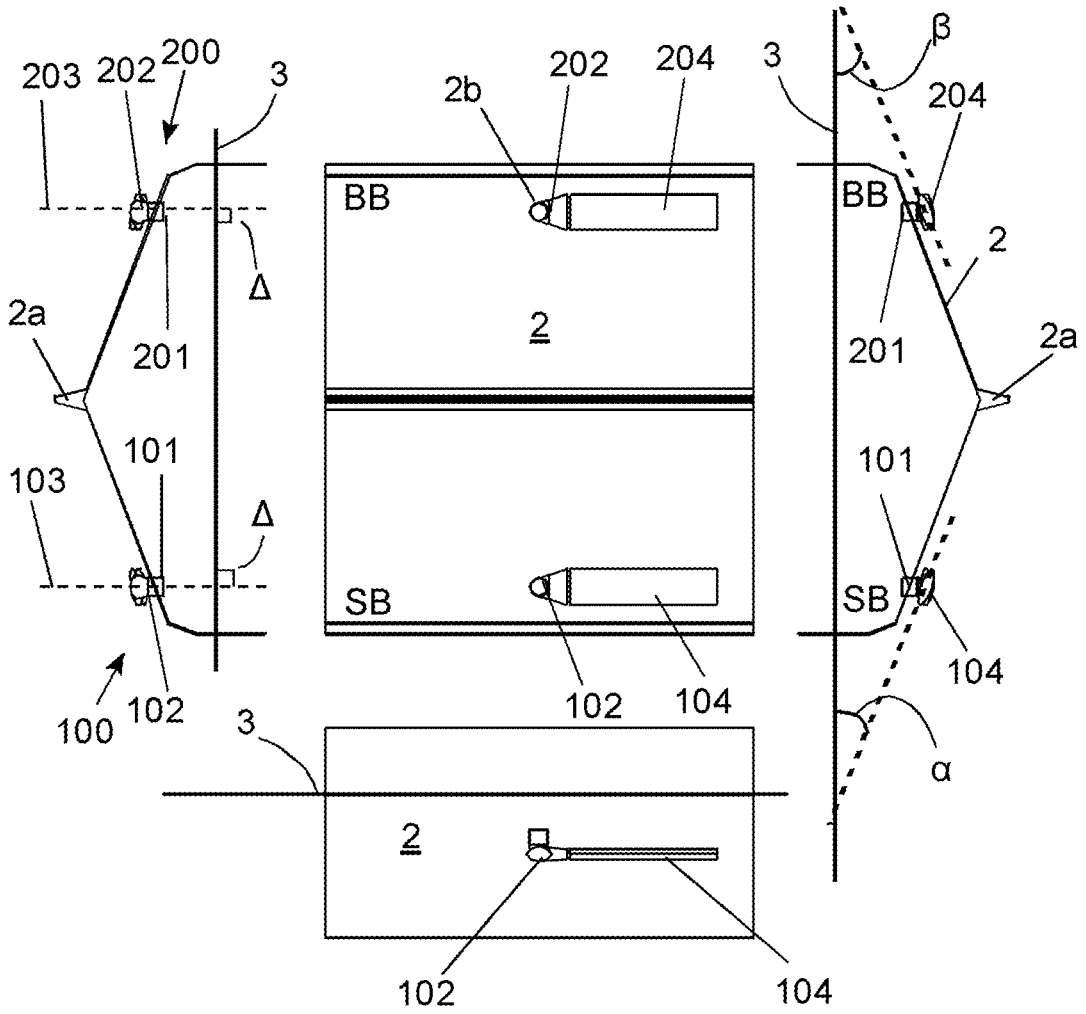
Figure 5B:
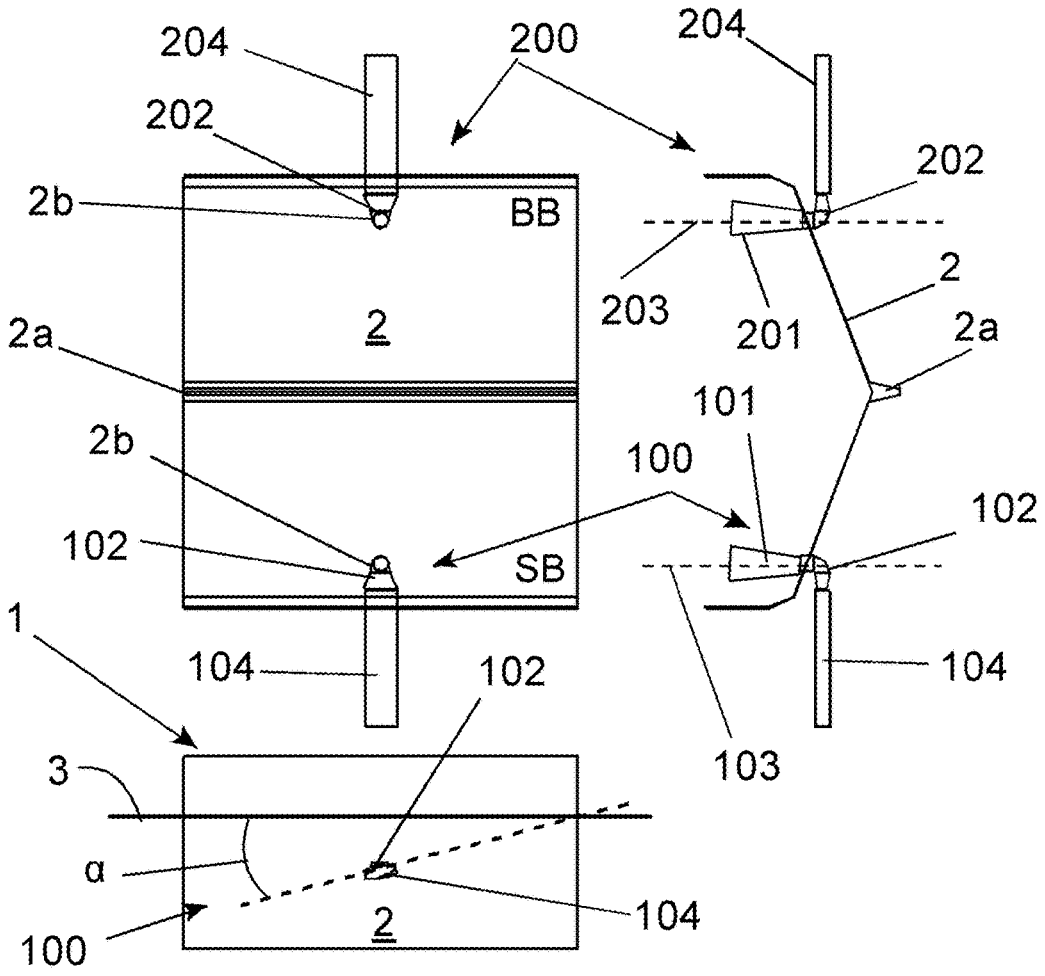

FIGS. 5A-5B show a combined front, bottom, rear and side view (starboard side SB) of a vessel 1 provided with a first embodiment of a system 100 (200) according to the invention for actively damping a ship's motion. In FIGS. 5A-5B the vessel is provided with the letter combinations BB and SB designating the port side and the starboard side, respectively, of the vessel. In this case, too, the vessel 1 floats on a water surface 3, with numeral 2 indicating the part of the ship's hull below the water surface 3, whilst numeral 2*a* indicates the keel.

The system 100 is partially accommodated in the hull 2 of the vessel 1 and on the other hand comprises a stabilisation element 104 that extends from the ship's hull 2 into the water via an opening 2*b*. In this embodiment, the stabilisation element 104 is configured as a wing which extends from the hull 2 on the longitudinal side of the vessel, the starboard side SB of the vessel in this figure, below the water line 3. The stabilisation element 104 configured as a wing is connected to the vessel, more particularly to moving means 101, by means of a universal joint 102.

The moving means 101 are configured to drive the universal joint 102 about a pivot axis 103, which pivot axis 103 extends perpendicular (see the angle indication Δ) relative to the water surface 3. Because of this, the wing-shaped stabilisation element 104 undergoes an angular or pivoting movement about the pivot axis 103, as a result of which the stabilisation element 104 is moved through the water like a wing in a horizontal plane parallel to the water surface 3.

Figure 5C:
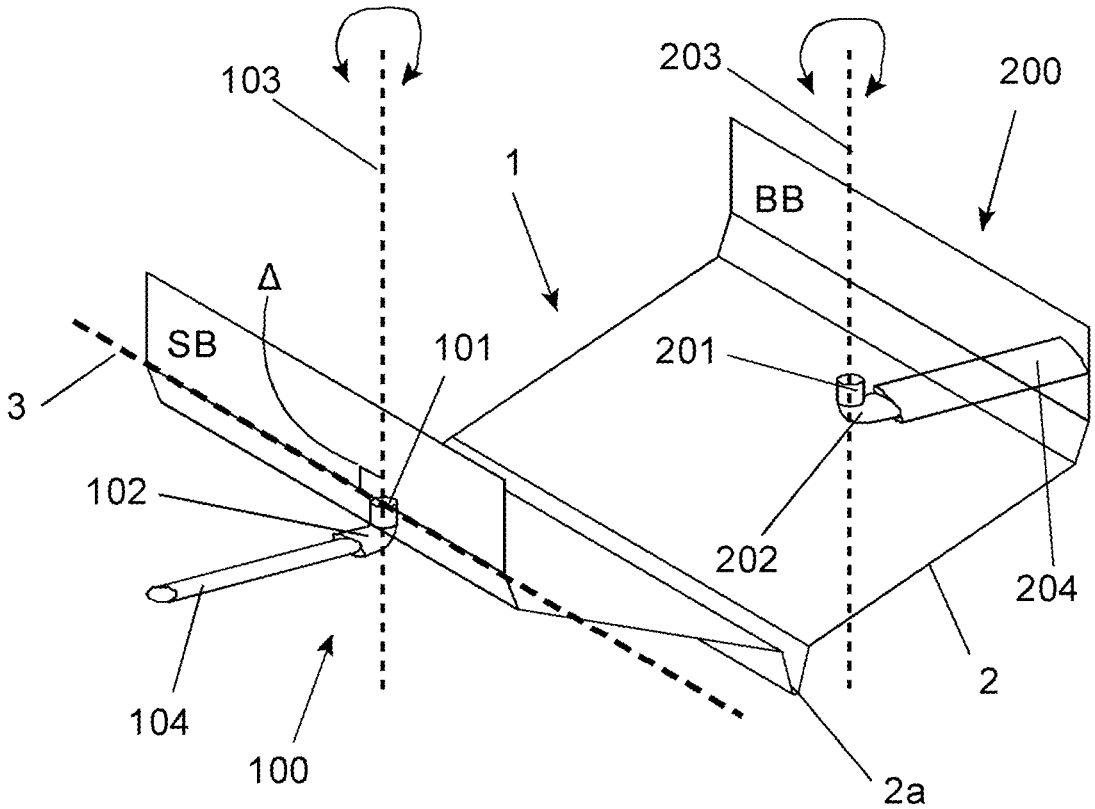

In FIG. 5A the stabilisation element 104-204 is parked in the 0° position, in which it has pivoted against the hull (least resistance), whilst in FIGS. 5B and 5C the stabilisation element 104-204 has pivoted about its respective pivot axis 103-203 from the parked position and extends from the ship's hull 2 for stabilising the ship's motion.

The wing-shaped stabilisation element 104 is connected to the universal joint 102 at an adjustable tilt angle α, so that the tilt angle of the wing 104 about its wing axis 106 relative to the water surface 3 can be adjusted during the pivoting movement through the water.

In FIGS. 5A and 5B, a stabilisation system 100 according to the invention is shown on the starboard side SB, whilst a similar stabilisation system 200 is disposed on the port side BB. To obtain a better functionality, it is also usual to equip a vessel 1 with two stabilisation systems according to the invention, which are disposed on the port side BB and the starboard side SB, respectively.

The stabilisation system according to the invention that is present on the port side BB is indicated by numeral 200. This active stabilisation system 200 drives the wing-shaped stabilisation element 204, which pivots about its pivot axis 203, in an identical manner. The tilt angle of the wing-shaped stabilisation element 204 is indicated β in the figures, which means that the tilt angles α and β of the wing-shaped stabilisation elements 104 and 204, respectively, can be set independently of each other. Usually, the tilt angles will be identical to each other (angle α=β, or angle β=−α) so as to realise a good control (stabilisation of the ship's motion).

The system for stabilising a ship's motion, wherein an angular or pivoting movement in a horizontal plane is imparted to pivotable but non-rotatable wing-shaped stabilisation elements with an adjustable tilt angle α and β, which are present on either side of the vessel, can be used with stationary vessels as well as with slow sailing vessels.

With reference to FIGS. 6A-6E, a stationary vessel will undergo a reciprocating (from port BB to starboard SB and vice versa) rolling motion (indicated R1, R2, R3, −R2 etc.) about its longitudinal axis 1' under the influence of the swell of the water. To dampen or oppose this rolling motion, the stabilisation element 104-204 is moved about the pivot axis 103-203 by the moving means from the parked position shown in FIG. 6A in the direction of the stem (indicated by arrow F) toward the position 104', wherein the wing-shaped stabilisation element extends more or less perpendicular to the ship's hull 2, which operating situation corresponds to the situation shown in FIG. 1C.

Figure 7:
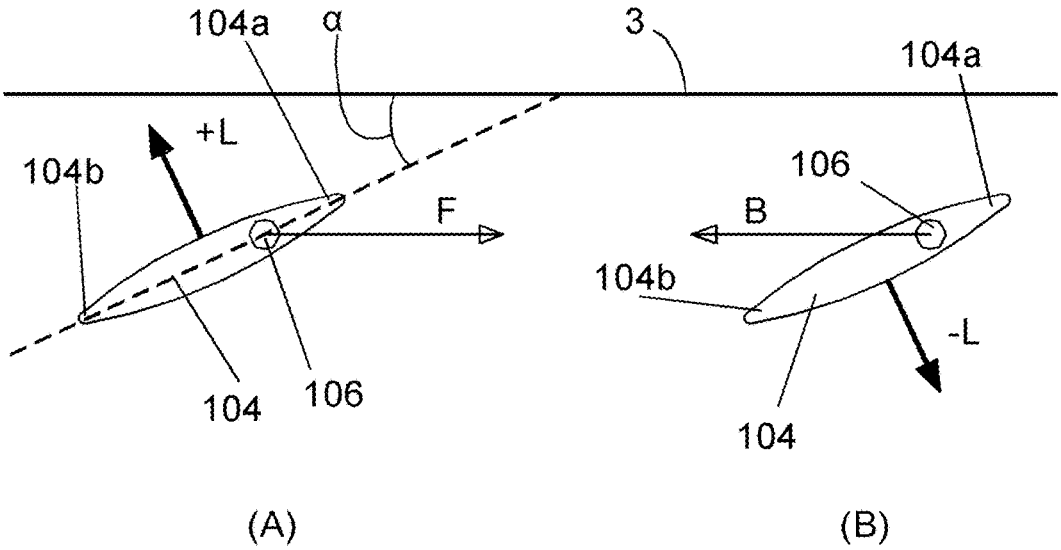
FIG. 7A-7B show the dynamics of a wing-shaped stabilisation element in the application of FIG. 5.

Because the stabilisation element 104-204 extends more or less perpendicular to the axis 103-203, which pivot axes 103-203 extend perpendicular relative to the water surface 3, the stabilisation element 104-204 moves like a wing in a horizontal plane through the water during its angular displacement about the axis 103-203 by the moving means 101-201. In the case of a forward pivoting movement F in the direction of the vessel's stem, the upstream/front edge 104'-204' of the wing-shaped stabilisation element 104-204 "cuts" through the water mass, whilst in the case of a backward pivoting movement B in the direction of the vessel's stern, it is the downstream/rear edge 104"-204" that cuts through the water. See also FIGS. 7A-7B.

The tilt angle α that the wing-shaped stabilisation element 104-204 assumes relative to the water surface 3, the pivoting direction of the wing-shaped stabilisation element through the water (in the direction F of the stem or in the direction B toward the stern), as well as the speed at which the wing-shaped stabilisation element 104-204 is pivoted through the water, are determined in dependence on the sailing speed of the vessel and the control signals delivered by the sensor means concerning the ship's motion (the ship's roll) being sensed, creating a lifting effect (indicated +L and −L, respectively, in FIGS. 7A-7B, and +L1, +L2, −L1, −L2 in FIGS. 6A-6E), which provides the desired damping action for correcting the motion of the vessel 1. See FIGS. 7A-7B in combination with FIGS. 6A-6E.

This means that during the rolling motion from port BB to starboard SB about the longitudinal direction 1' of the vessel 1, the stabilisation system 1 present on the starboard side SB opposes the downward movement on the starboard side SB with the wing-shaped, non-rotating stabilisation element 104 via the lifting force +L1 directed toward the water surface 3. The stabilisation system 200 present on the port side BB will at the same time generate a similar correction force −L1 with its wing-shaped, non-rotating stabilisation element 204, which force opposes the upward movement +R1 and +R2 of the port side BB of the vessel 1 (FIG. 6B).

Upon further forward pivoting movement F of the two wing-shaped, non-rotating stabilisation elements 104-204, as shown in FIG. 6C (position 104'-204'), the lifting effect will reach its greatest lifting force +L2 and −L2, until the wing-shaped stabilisation elements 104-204 assume the most forward pivoted position in FIG. 6D (position 104"-204") and subsequently make a backward pivoting movement B in the direction of the ship's stern (FIG. 6E).

Because the vessel undergoes an opposite rolling motion from starboard SB to port BB about the longitudinal direction 1' of the vessel 1 in this FIG. 6E, the two wing-shaped, non-rotating stabilisation elements 104-204 cut through the water in a horizontal plane, each in a pivoting movement directed toward the ship's stern, because their tilt angle α does not change, however, the lifting force of each stabilisation element 104-204 thus realised is opposed to the rolling motion, wherein the wing-shaped stabilisation element 104 generates a correction force −L1 that opposes the upward movement −R2 of the starboard side SB of the vessel 1, whilst the wing-shaped stabilisation element 204 generates a correction force +L1 that opposes the downward movement −R2 of the port side BB of the vessel 1 (FIG. 6E).

Using this arrangement comprising a stabilisation system both on the port side BB and on the starboard side SB, it is possible, given a suitable control and drive of the two wing-shaped stabilisation element 104 and 204 in terms of pivoting direction and speed about their pivot axes 103 and 203, respectively, and a set tilt angle α and β, respectively, of the wing 104-204 relative to the water surface 3, to generate a lifting force having a force component directed toward or away from the water surface 3 with a stationary vessel 3 at anchor. This upward or downward force component of the lifting effect created by the wing 104-204 moving through the water can be utilised very effectively for compensating the roll of the stationary vessel 1 about its longitudinal axis I'.

In the case of a stationary vessel and a non-operational stabilisation system according to the invention, the stabilisation element 104-204 is parked in the 0° position as shown in FIGS. 5A and 6A. In this parked position, the stabilisation element 104-204 has been rotated by means of the universal joint 102-202 and placed against the ship's hull 2, directed toward the stern (on the right in FIG. 5A, the stem of the vessel 1 is located on the left in FIG. 5A).

Optionally, a recess (not shown) may be provided in the ship's hull 2, so that the stabilisation element 104-204 can be received in this recess in the parked position 0° (indicated at 104*a*). The recess is optional, however, as it requires a more complex adaptation of the ship's hull 2.

The angular displacement or pivoting speed of the wing-shaped stabilisation element 104-204 about its pivot axis 103-203 is set by the driving means 101-201 in dependence on the sailing speed of the vessel and control signals delivered by sensor means of the active stabilisation system 100, which sensor means sense the rolling motion of the vessel 1 (direction, speed and acceleration of the ship's roll).

Likewise, the tilt angle α (or β) of the wing 104-204 about its wing axis 106-206 and relative to the water surface 3 is set by the moving means 101 in dependence on the sailing speed of the vessel and control signals delivered by sensor means of the active stabilisation system 100, which sensor means sense the rolling motion of the vessel 1 (direction, speed and acceleration of the ship's roll).

In a first embodiment, the stabilisation principle of which is elaborated in FIGS. 6A-6E, the starting point is a stationary vessel. The sailing speed is v=0 kn in this situation, and on the basis of this and the control signals generated and delivered as a result of the ship's motion, the moving means 101-201 impart the angular displacement (pivoting movement) at a specific pivoting speed to the wings 104-204, which are moreover set at a specific, preferably fixed tilt angle α (or β) relative to the water surface.

Figure 8:
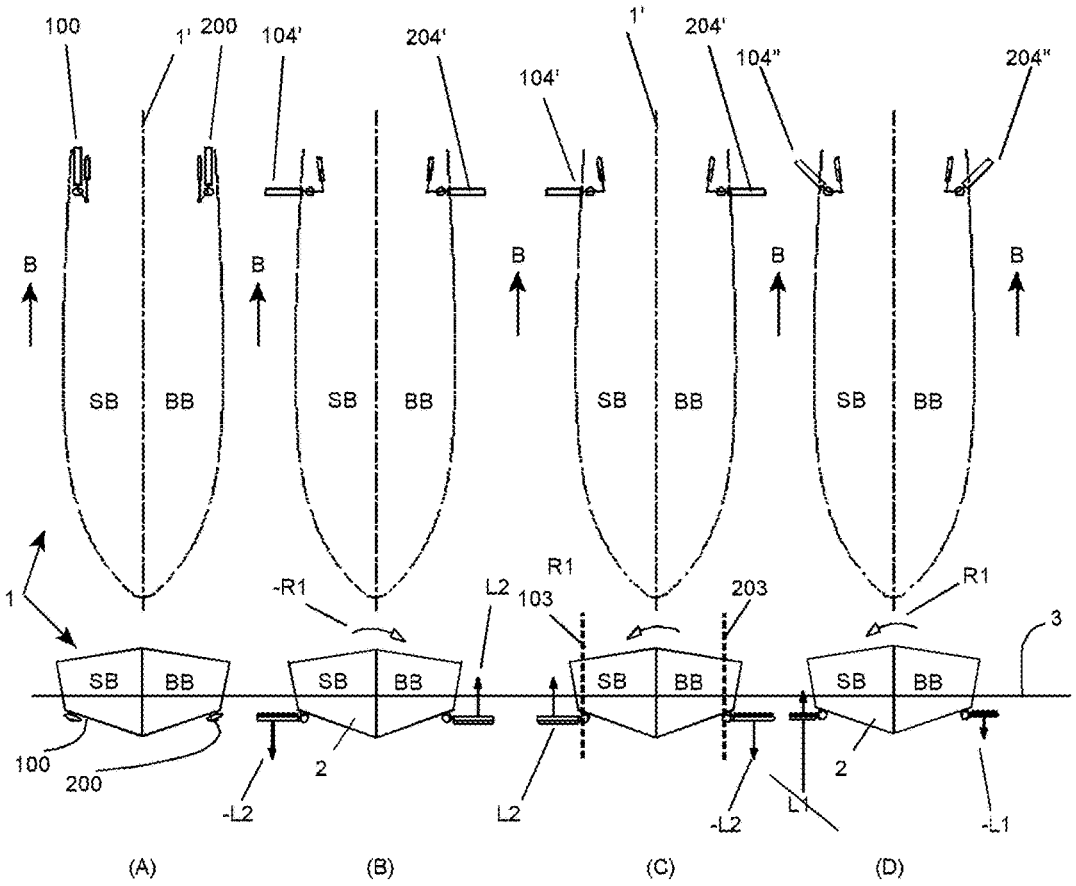
FIGS. 8A-8D show a second application of an active stabilisation system according to the invention.

In another embodiment, the stabilisation principle of which is elaborated in FIG. 8 (subfigures A-D), the starting point is a moving vessel. The arrow B in FIGS. 8A-8D show is the backward direction of flow (B=backward) of the water past the wing-shaped stabilisation element 104-204 resulting from the forward movement of the vessel 1 through the water.

The sailing speed is v≠0 kn (in fact v>0 kn) in this situation, and on the basis of this and the control signals generated and delivered as a result of the ship's motion, the moving means 101-201 impart a specific, fixed angular position (pivot orientation) relative to the ship's hull 2 to the wings 104-204, whilst in addition a variable tilt angle α (or β) relative to the water surface 3 is constantly imparted to the wings 104-204.

Figure 9:
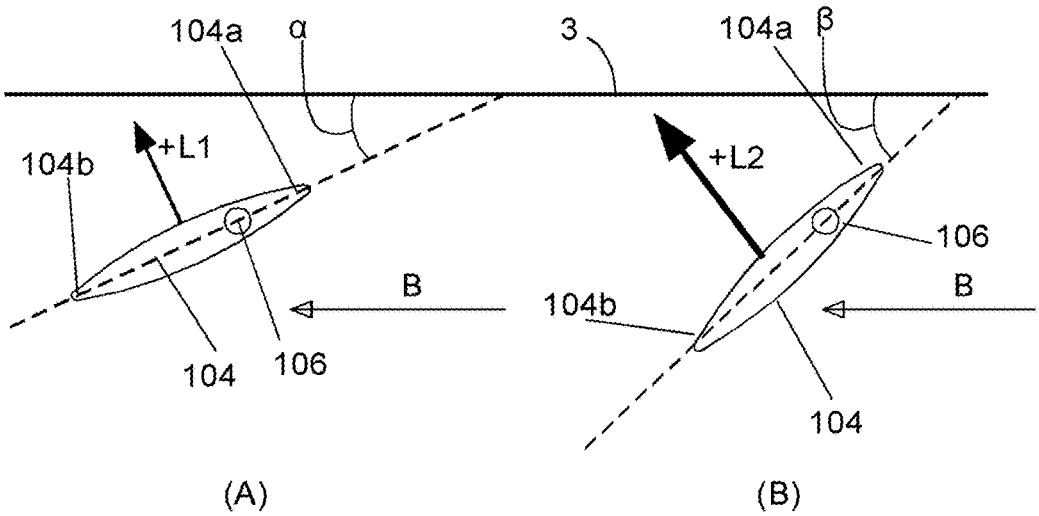
FIGS. 9A-9B show the dynamics of a wing-shaped stabilisation element in the application of FIG. 8.

In FIG. 8A, the stabilisation element 104-204 is parked in the 0° position or starting position in an analogous manner as in FIGS. 5A and 6A. While sailing (FIGS. 8B and 8C), the two wings 104-204 have been pivoted outward (rotated) to an angle of 90°, being perpendicular to the ship's hull 2, about their angular displacement axis 103-203 oriented perpendicular to the water surface 3 by the moving means 102-202. While sailing and during roll stabilisation control, the wings 104-204 are held in this pivoted position, and the tilt angle α-β of each wing 104-204 relative to the water surface 3 is set (see FIG. 9A) between −90° and +90° relative to the water surface in dependence on the ship's roll being sensed.

The lifting or correction force (+L1 and +L2 in FIGS. 9A-9B) thus generated constantly opposes the ship's roll being sensed, because this lifting or correction force invariably includes at least a force component directed toward or away from the water surface 3. This upward or downward force component of the lifting or correction force can be utilised very effectively for compensating the movements of the sailing vessel 3 about its longitudinal axis 1'.

The moment (see FIG. 8B) the rolling motion −R1 of the vessel from starboard SB to port BB is sensed, the wing-shaped stabilisation element 204' is set at a tilt angle β as shown in FIG. 9B, so that the water flowing past the wing 204' exerts a lifting force +L2 toward the water surface 3 on the wing 204', thereby opposing the downward rolling motion −R1 of the port side BB of the vessel 1.

Likewise, the wing 104' is set at a tilt angle −β (with the downstream side 104*b* of the wing 104' facing the water surface and the upstream side 104*a* facing away from the water surface 3), so that the lifting force −L2 thus generated will be directed downward and thus oppose the upward rolling motion −R1 of the starboard side SB of the vessel 1.

The moment the rolling motion −R1 has come to a standstill and the vessel undergoes a rolling motion +R1 from port BB to starboard SB (FIG. 8C), the tilt angles of the wings 104'-204' of the stabilisation element 104 will be adapted accordingly, so that the lifting force +L2 toward the water surface 3 being generated by the wing 104' will oppose the downward rolling motion +R1 of the starboard side SB of the vessel 1 whilst simultaneously therewith the lifting force −L2 away from the water surface 3 being generated by the wing 204' will oppose the upward rolling motion +R1 of the port side BB of the vessel 1.

In this application of the stabilisation system according to the invention, the tilt angles of the wing 104-204 are set variably in a tilt angle range between −90° to +90° relative to the water surface 3.

In the case of increasing sailing speeds it may be desirable to set the wings 104"-204" (FIG. 8D) at an angle of 45°, for example, relative to the ship's hull 2 so as to thus decrease the resistance that the vessel 1 moving at a high speed experiences with the wings 104-204 set at a 90° angle (as shown in FIGS. 8B-8C). In the situation as shown in FIG. 8D, in which the stabilisation element 104 takes up a fixed pivoted position of 45° relative to the ship's hull 2, the friction resistance of a moving vessel is lower, whilst also the lifting forces +L1 and −L1 being generated are smaller than the lifting forces +L2 and −L2 in the 90° position, but the correction effect on the ship's motion is still effective.

The advantage of this stabilisation control is that the stabilisation system can be active at all times while sailing, independently of the sailing speed, and that the frictional resistance experienced by the wings 104-204 is considerably less than the frictional resistance experienced by a prior art stabilisation system, in which the wings 104-204 take up a fixed (perpendicular) position relative to the ship's direction of movement and are thus not constantly adjusted.

Figure 10:
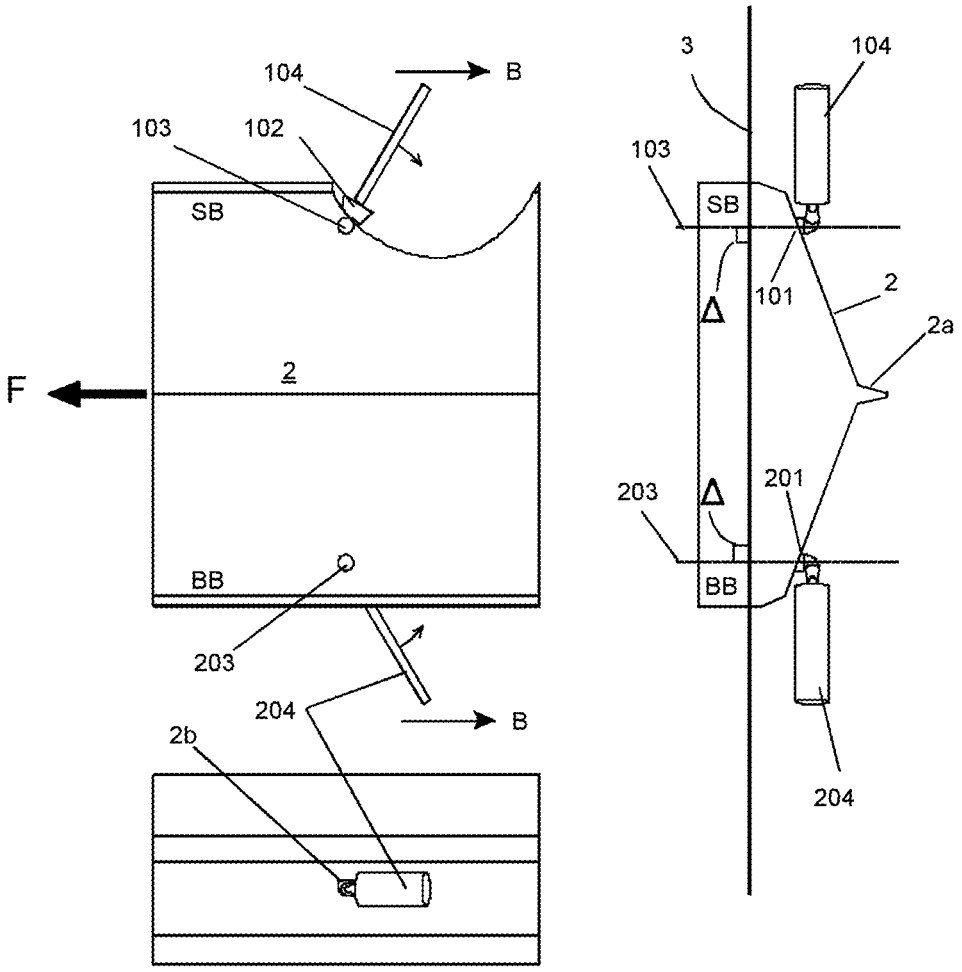
FIG. 10 shows a third application of an active stabilisation system according to the invention.

FIG. 10 discloses another application, in which the vessel 1 is shown from an upper side, a rear side and a port side and in which a backward pivoting movement B (B=Backward) in the same direction and at the same tilt angle is simultaneously imparted to the two wings 104-204. If the wings 104-204 are set at a 0° tilt angle (being the feathering position, parallel to the water surface 3) during the movement to the stem, the wings 104-204 will cut through the water practically without friction. If the wings 104-204 are set at a 90° tilt angle (perpendicular to the water surface 3) during the return movement toward the stern, a propulsion force will be generated, which will cause the vessel 1 to move forward (letter F=Forward).

The magnitude of this propulsion force depends on the pivoting angle of the wings and the pivoting speed. Making use of these forces, which can be directed forward and backward, the vessel 1 can move forward and backward but also change direction.

Providing or connecting the stabilisation system with/to location determination means, such as GPS, and causing the moving means 101-201 to impart the angular displacement to the wings 104-204 and to set the tilt angle of the wings 104-204 partially on the basis of the determined location of the vessel, makes it possible to keep the vessel 1 at a desired location or position without having to activate the main propulsion system or bow and stern thrusters.

Figure 11:
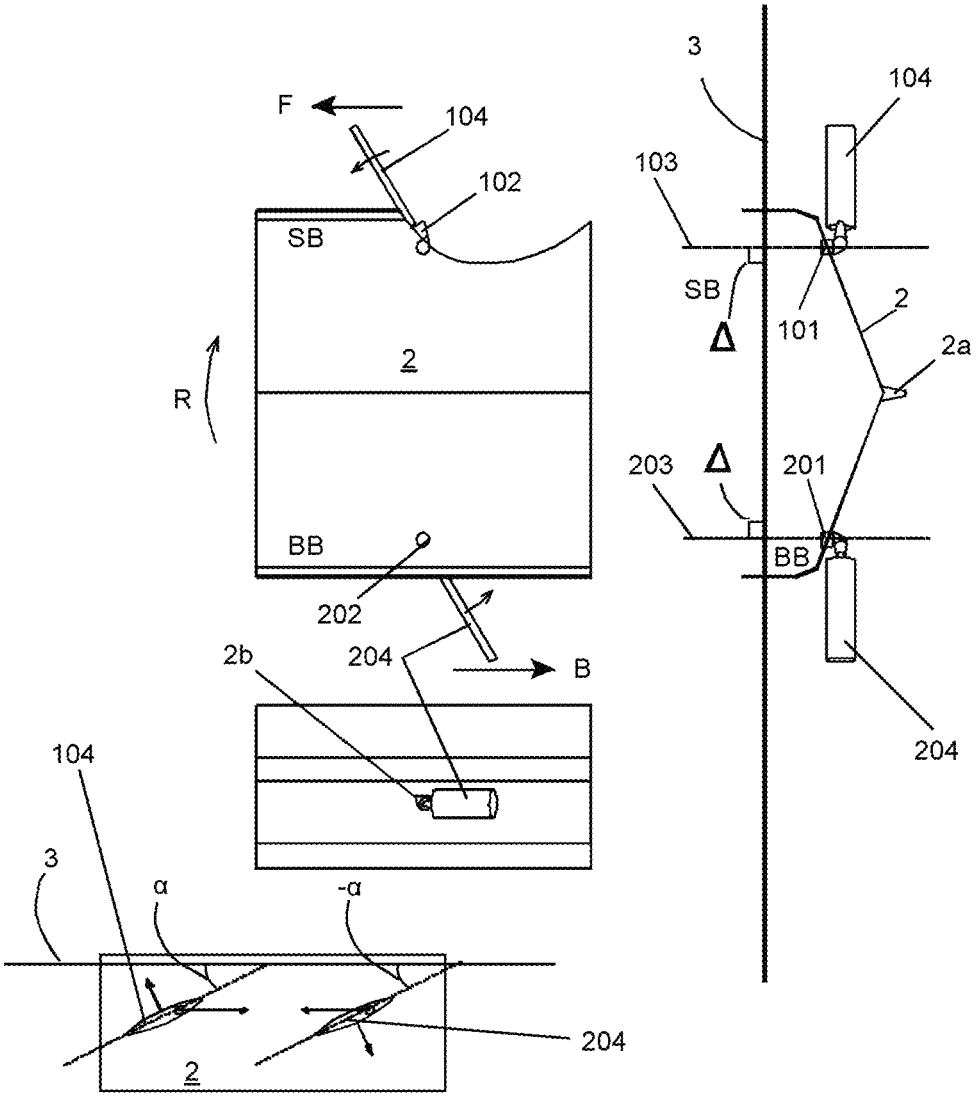
FIG. 11 shows a fourth application of an active stabilisation system according to the invention.

FIG. 11 shows yet another application, in which the vessel 1 is shown from an upper side, a rear side and a port side and in which the wings 104-204 are both set at a 90° tilt angle, for example, and are each driven in a different direction relative to the vessel. The port wing 204 pivots toward the stern (letter B=Backward), whereas the starboard wing 104 pivots toward the stem (letter F=Forward). In this example the vessel will thus turn to the right (letter R=Right).

In combination with the application as shown in FIG. 10 and in combination with location determination means, such as GPS, simple manoeuvres of the vessel 1 can be carried out without having to activate the main propulsion system or bow and stern thrusters.

Figure 6:
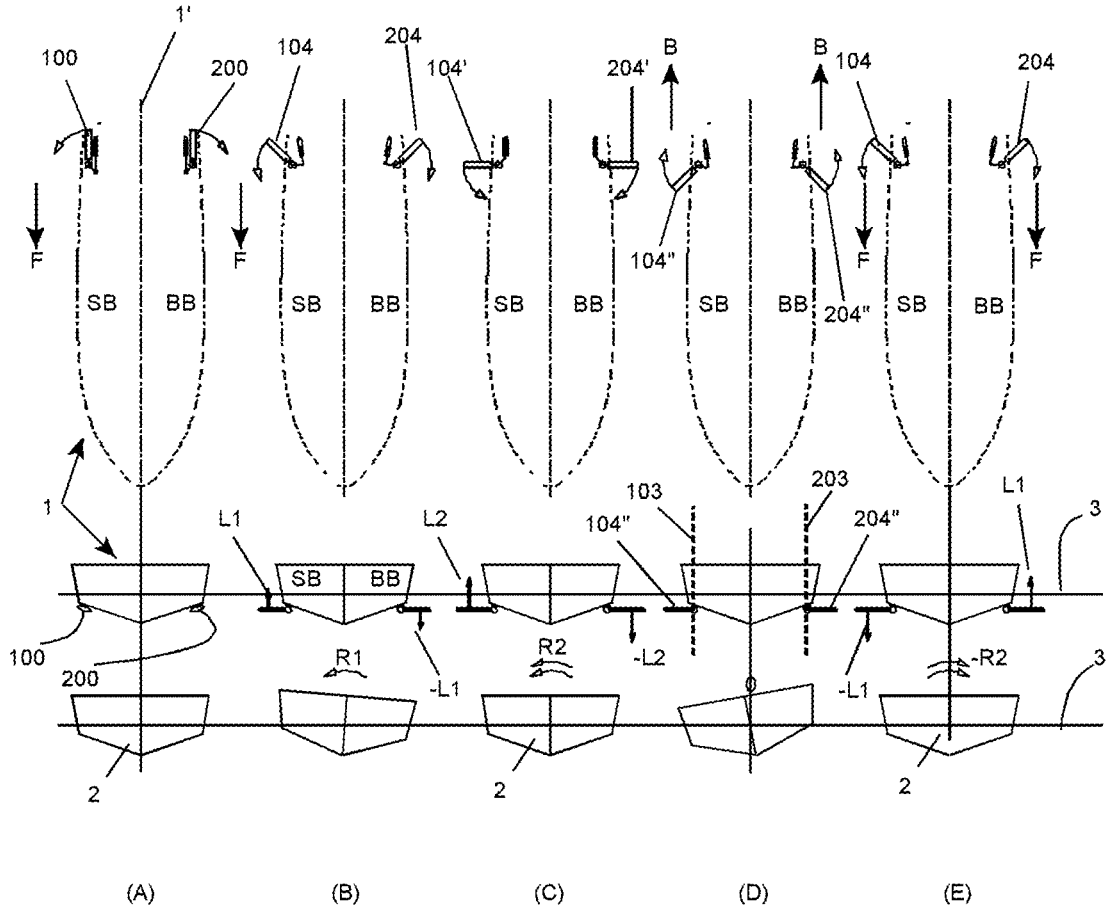
FIGS. 6A-6E show a first application of an active stabilisation system according to the invention.

As shown in FIG. 6, the stabilisation systems 100-200 are disposed near the stern of the vessel 1. In this arrangement, the system can be used in particular for damping the vessel's so-called pitch movements. This is done by measuring the pitch movements and converting them into control signals intended for controlling the two stabilisation systems 100-200 by displacing the vessel about the horizontal transverse axis.

It is also possible, however, to position the roll stabilisation systems 100-200 elsewhere in the ship's hull 2, for example in the middle of the vessel 1.

Figure 12:
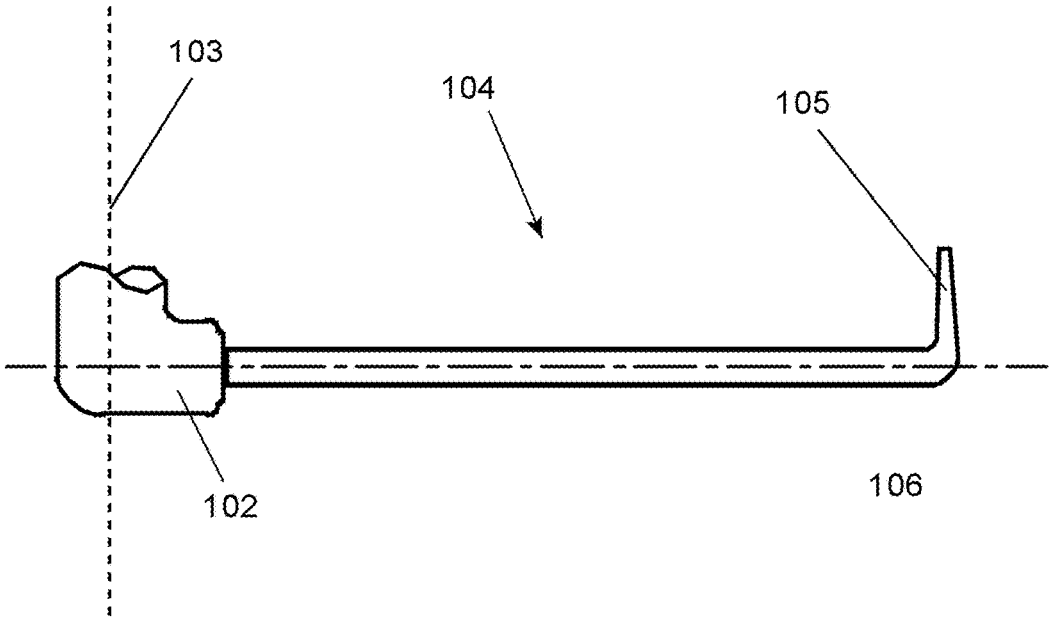
FIG. 12 shows a wing-shaped stabilisation element according to the invention.

FIG. 12 shows a specific embodiment of a wing-shaped stabilisation element 104 as used in the present invention. It should be noted that the wing-shaped stabilisation element 104 is not fully rotatable about its axis 106, which means that a full 360° rotation is not possible. The wing-shaped stabilisation element 104 can be pivoted about the angular rotation axis (pivot axis 103) and tilted about its longitudinal axis 106 by means of the universal joint 102 and the driving means 101 (not shown).

Figure 13:
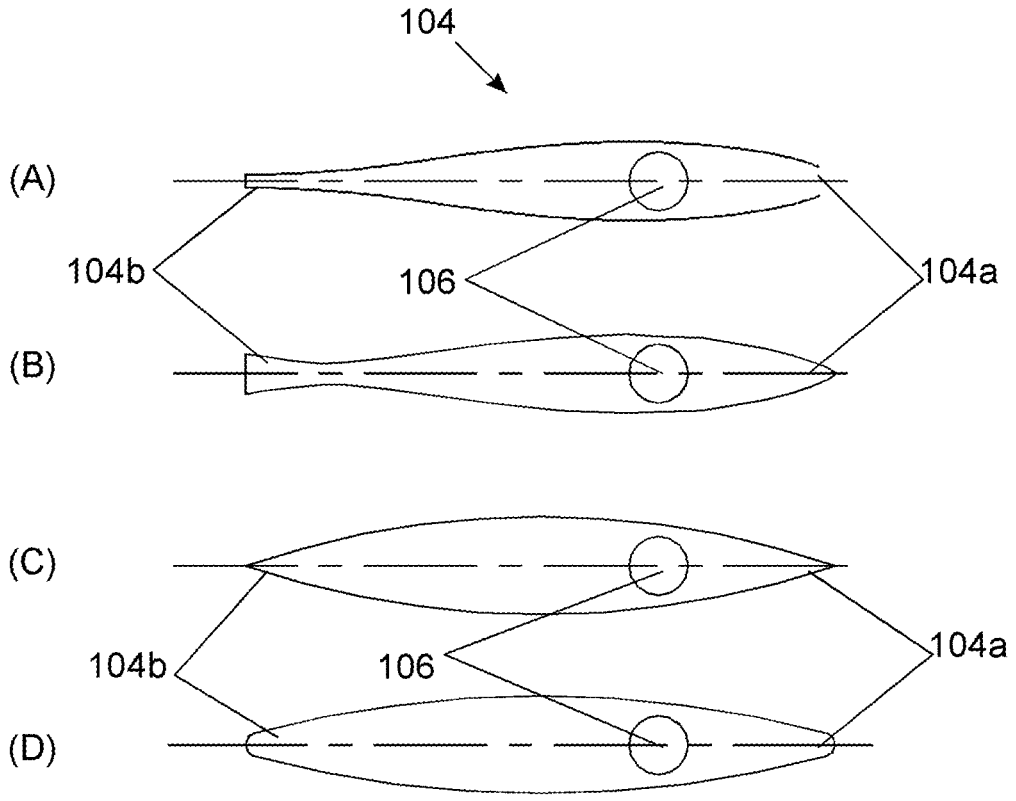
FIGS. 13A-13D show various sections of a wing-shaped stabilisation element according to the invention.

The wing-shaped stabilisation element 104 preferably has a wing shape as shown in a number of exemplary embodiments in FIGS. 13A-13D. The upstream longitudinal side 104*a* of the wing-shaped stabilisation element 104 may be curved (FIGS. 13A-13B and 13D) or pointed (FIG. 13C). Likewise, the downstream longitudinal side 104*b* of the wing-shaped stabilisation element 104 may be rounded or curved (FIG. 13D) or pointed (FIG. 13C) or otherwise be provided with a blunt end (FIG. 13A) or a thickened end (FIG. 13B).

A specific embodiment as shown in FIG. 12 shows the winglet 105 that is provided on the free end of the wing-shaped stabilisation element 104. The winglet 105 is preferably directed toward the water surface, but in another embodiment it may also be directed away from the water surface. Swirling in the water flowing past the wing-shaped stabilisation element 104 is significantly reduced thereby, both in the case of stationary ships and in the case of moving ships. The wing-shaped stabilisation element 104 can thus be moved through the water in a simpler and more efficient manner, so that the driving mechanism can be of less sturdy construction. At the same time, the induced resistance that the stabilisation element 104 experiences in the water will decrease.

As regards the wing-shaped stabilisation elements 104-204 as used in the roll stabilisation system according to the invention, the wing-shaped stabilisation element has an aspect ratio between 1 and 10. The aspect ratio AR is understood to mean the ratio determined by the length dimension divided by the average horizontal width. By using wing-shaped stabilisation elements having a high aspect ratio between 1 and 10, such stabilisation elements can also be used for other applications than merely roll stabilisation.

If, for example, a wing-shaped stabilisation element having an aspect ratio AR of 4 is used with a tilt angle of, for example, 20° relative to the water surface, and induce lifting force (i.e. the damping force exerted on the vessel by the stabilisation element for opposing the rolling motion being sensed) will be about six times greater than the resistance force being experienced (the force that needs to be exerted for moving the stabilisation element through water or the force from the water flowing past that is experienced by the stabilisation element).

As a result, the wing-shaped stabilisation elements can also be used for manoeuvres such as trimming, pitch damping and positioning of ships. These additional applications are in particular suitable if the active roll stabilisation systems provided with wing-shaped stabilisation elements having such a high aspect ratio are preferably installed near the vessel's stern, as for example shown in FIG. 6.

By furthermore making the rotatable stabilisation element of a lightweight material, such as carbon fibre, a considerable saving in weight and mass inertia reduction can be realised, so that the entire driving system of the active roll stabilisation system can be of simpler construction.

Figure 14A:
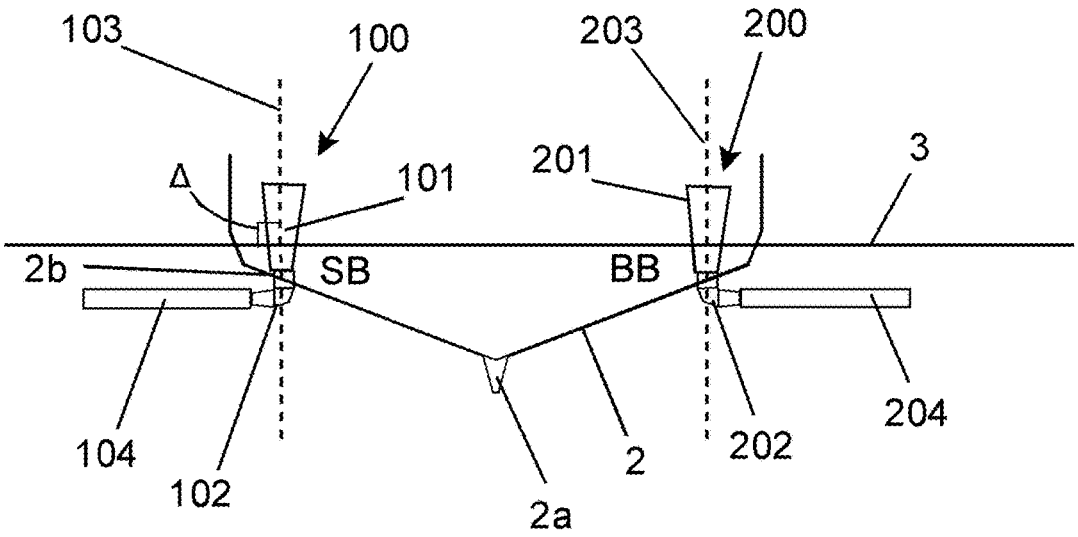
FIGS. 14A-14B show two functional embodiments of an active stabilisation system according to the invention.

FIG. 14A shows another front view of a vessel 2, which is provided with a stabilisation system 100 according to the invention on the starboard side SB, whilst a similar stabilisation system 200 is disposed on the port side BB. In this embodiment, whose functionality regarding damping or compensating or opposing the motion of the vessel 2 has been explained with reference to the above description of FIGS. 5-11, the pivot axis 103-203 about which a pivoting movement in the direction of the stem or the stern of the vessel is imparted to the wing-shaped stabilisation element 104-204 (a use), extends perpendicular (see angle indication Δ) relative to the water surface 3 (and the deck surface of the ship in its position of rest). As a result, the wing-shaped stabilisation element 104-204 undergoes a pivoting movement about the pivot axis 103-203, so that the stabilisation element 104-204 is moved through the water like a wing in a horizontal plane more or less parallel to the water surface 3.

Figure 14B:
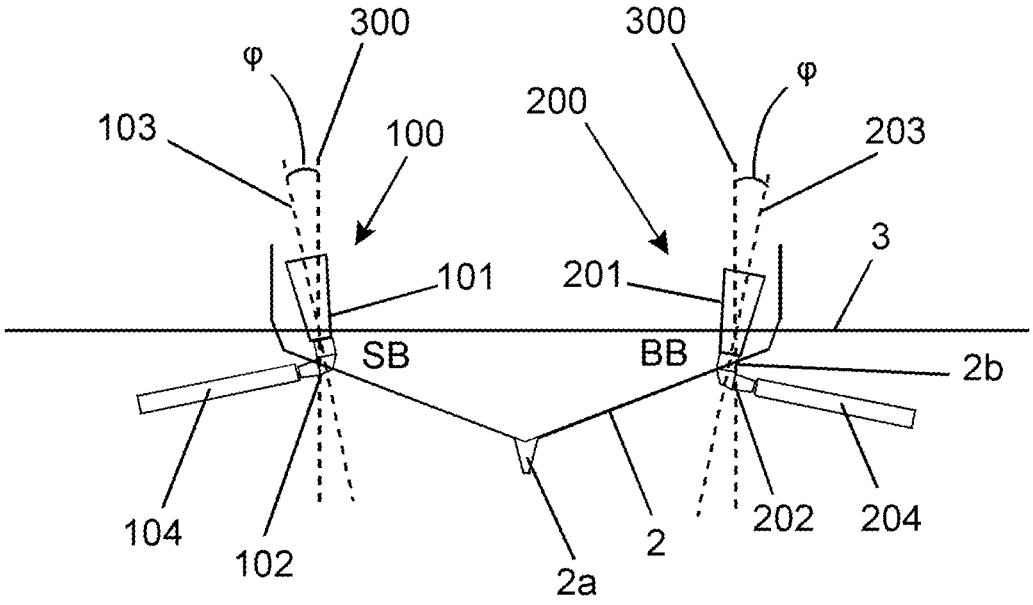

FIG. 14B likewise shows in another embodiment of an active system for stabilising a ship's motion a front view of a vessel 2, which is provided with a stabilisation system 100 according to the invention on the starboard side SB, whilst a similar stabilisation system 200 is disposed on the port side BB. In this embodiment, the pivot axis 103-203 does not extend perpendicular relative to the water surface 3 (and the deck surface of the ship in its position of rest), but the pivot axis 103-203 extends at a (small) angle (see the angle indication φ) relative to the water surface 3 (and the line 300 perpendicular thereto).

The angle φ can range between 0° (perpendicular to the water surface) and 15°.

Because the stabilisation element 104-204 is oriented more or less perpendicular to its respective pivot axis 103-203 in this embodiment as well, the wing-shaped stabilisation element 104-204 makes a pivoting movement about its pivot axis 103-203 during operation, wherein the stabilisation element 104-204 is moved through the water like a wing in a pivoting plane which is not oriented parallel the water surface 3 in this case but at an angle thereto. The stabilisation elements 104-204 extend deeper into the water in this case, so that they will not project above the water surface in the case of very strong rolling motions of the ship.

The invention claimed is:

1. A system for damping a vessel's motion using a lifting effect, comprising:

one first stabilisation element that extends from the vessel's hull, below the water line, on a side of the vessel, wherein at least one stabilisation element is configured as a wing, sensor means for sensing the vessel's motion and delivering control signals on the basis there of, moving means for moving the at least one wing-shaped stabilisation element relative to the hull, characterised in that the moving means are configured for imparting a non-rotatable pivoting movement in the direction of a stem or a stern of the vessel to the at least one wing-shaped stabilisation element and setting a tilt angle of the at least one wing-shaped stabilisation element relative to the ship's hull in dependence on the speed of the vessel and the control signals delivered by the sensor means, such that the lifting effect generated by the at least one wing-shaped stabilisation element will have a damping effect on the ship's motion being sensed.

2. A system according to claim 1, characterised in that the moving means are configured for setting the at least one wing-shaped stabilisation element at a tilt angle at a sailing speed v=0 kn whilst at the same time imparting an angular displacement movement relative to the ship's hull to the at least one wing-shaped stabilisation element.

3. A system according to claim 1, characterised in that the moving means are configured for imparting a variable tilt angle to the at least one wing-shaped stabilisation element at a speed v≠0 kn whilst at the same time setting a fixed pivot angle of the at least one wing-shaped stabilisation element relative to the hull.

4. A system according to claim 1, characterised in that the wing-shaped stabilisation element is connected to the vessel by means of a universal joint.

5. A system according to claim 1, characterised in that the wing-shaped stabilisation element can be accommodated in a recess provided in the ship's hull.

6. A system according to claim 1, characterised in that at least one wing-shaped stabilisation element is provided on each longitudinal side of the vessel.

7. A system according to claim 6, characterised in that the set of wing-shaped stabilisation elements is provided near the rear of the vessel.

8. A system according to claim 1, characterised in that the wing-shaped stabilisation element is provided with a winglet at its free end.

9. A system according to claim 8, characterised in that the winglet is directed toward the water surface.

10. A system according to claim 8, characterised in that the winglet is directed away from the water surface.

11. A system according to claim 1, characterised in that the wing-shaped stabilisation element has an Aspect-Ratio ranging between 1 and 10, wherein the Aspect-Ratio is a length dimension of the wing-shaped stabilization element divided by an average horizontal width of the wing-shaped stabilization element.

12. A system according to claim 1, characterised in that the system further comprises location determination means, and that the moving means impart the non-rotatable pivoting movement in the direction of the stem or the stern of the vessel to the at least one wing-shape'd stabilisation element in part on the basis of the determined position of the vessel.

* * * * *